US005136547A

United States Patent [19]

Laukien

[11] Patent Number: 5,136,547

[45] Date of Patent: Aug. 4, 1992

[54] METHOD AND APPARATUS FOR REDUCING FOR REDUCING ACOUSTIC EMISSION FROM SUBMERGED SUBMARINES

[76] Inventor: Günther Laukien, Silberstreifen, D-7512 Rheinstetten-Forchheim, Fed. Rep. of Germany

[21] Appl. No.: 614,200

[22] Filed: Nov. 15, 1990

[51] Int. Cl.[5] ..... H04K 3/00

[52] U.S. Cl. ..... 367/1

[58] Field of Search ..... 367/1; 181/198, 207; 114/325, 342

[56] References Cited

FOREIGN PATENT DOCUMENTS

| | | |
|---|---|---|
| 0063517 | 4/1982 | European Pat. Off. . |
| 01205200 | 2/1984 | European Pat. Off. . |
| 0213418 | 8/1986 | European Pat. Off. . |
| 0237891 | 3/1987 | European Pat. Off. . |
| 1098730 | 7/1957 | Fed. Rep. of Germany . |
| 1772027 | 4/1967 | Fed. Rep. of Germany . |
| 1572497 | 7/1967 | Fed. Rep. of Germany . |
| 2318304 | 4/1973 | Fed. Rep. of Germany . |
| 3300067 | 1/1983 | Fed. Rep. of Germany . |
| 3332754 | 9/1983 | Fed. Rep. of Germany . |
| 3406343 | 2/1984 | Fed. Rep. of Germany . |
| 3600258 | 1/1986 | Fed. Rep. of Germany . |
| 2546127 | 5/1983 | France . |

*Primary Examiner*—Daniel T. Pihulic

*Attorney, Agent, or Firm*—Rosenblum, Parish & Isaacs

[57] ABSTRACT

A method and an apparatus are disclosed serving to minimize acoustic emission of submerged submarines. Moving mechanical elements in an inner region give off vibrations onto an outer hull via a vibration transmission path. The vibrations are damped with damping means in the vibration transmission path. The damping means is configured as an evacuated intermediate space and is inserted in the vibration transmission path.

45 Claims, 4 Drawing Sheets

Figure 1:
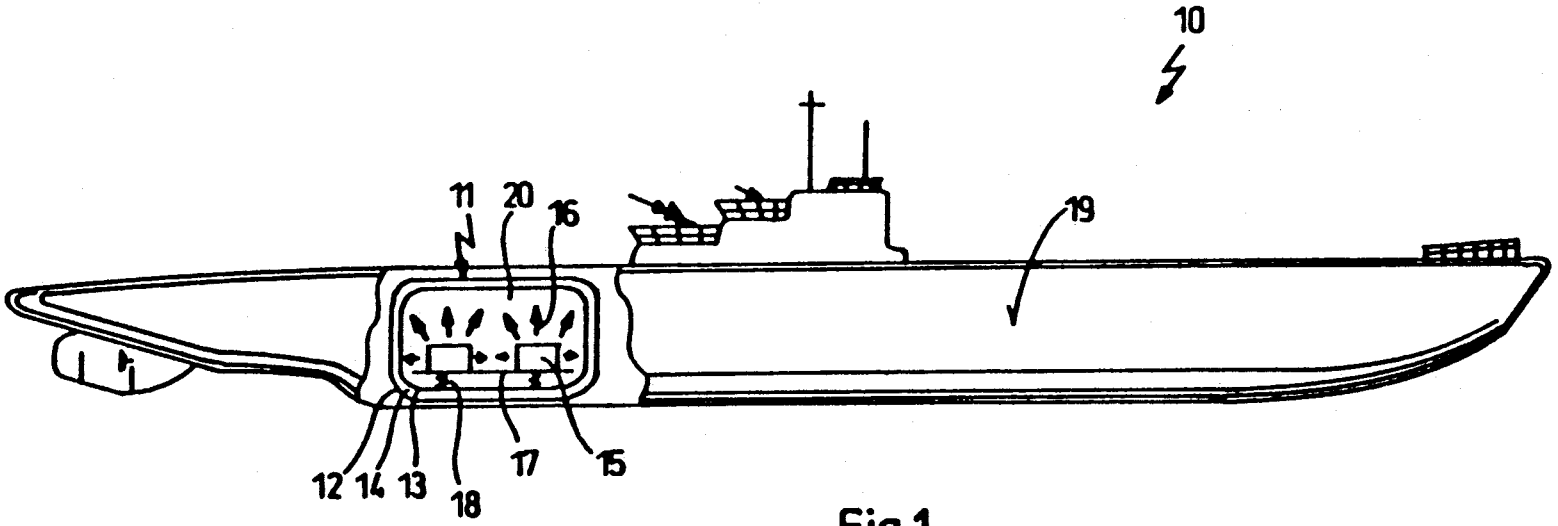

METHOD AND APPARATUS FOR REDUCING FOR REDUCING ACOUSTIC EMISSION FROM SUBMERGED SUBMARINES

The invention concerns a method for reducing acoustic emission from submerged submarines wherein moving mechanical elements in the inner region transfer vibrations to an outer hull via a transport path and the vibrations are attenuated on the transport path.

The invention further concerns an apparatus for the reduction of acoustic emission of submerged submarines with which damping means fare arranged between a moving mechanical element in the inner region of the submarine and an outer hull.

This application is related to the following co-pending U.S. Application filed on Nov. 15, 1990.

1) U.S. patent application entitled "METHOD FOR INFLUENCING AN ACOUSTIC SOURCE, IN PARTICULAR OF A SUBMERGED SUBMARINE, AND SUBMARINE", Ser. No. 07/614,300, filed Nov. 15, 1990, pending, corresponding to International Application PCT/DE 90/00197;

2) U.S. patent application entitled "METHOD AND APPARATUS FOR REDUCING ACOUSTIC EMISSION FROM SUBMERGED SUBMARINES", Ser. No. 07/602,310, filed Nov. 15, 1990, pending corresponding to International Application PCT/DE 90/00192;

3) U.S. patent application entitled "METHOD AND APPARATUS FOR LOCALIZING SUBMARINES", Ser. No. 07/615,423, filed Nov. 15, 1990, pending corresponding to International Application PCT/DE 90/00193;

4) U.S. patent application entitled "UNDERWATER VEHICLE WITH A PASSIVE OPTICAL OBSERVATION SYSTEM", Ser. No. 07/602,319, filed Nov. 15, 1990, panting corresponding to International Application PCT/DE 90/00196;

5) U.S. patent application entitled "METHOD FOR OPERATING SUBMERGED SUBMARINES AND SUBMARINES", Ser. No. 07/602,317, field Nov. 15, 1990, pending corresponding to International Application PCT/DE 90/00194;

6) German patent Application P3908573.2 entitled "METHOD AND APPARATUS FOR OPERATING SUBMERGED SUBMARINES".

Each of the above-identified applications is assigned to the Assignee of the present application, and the disclosures thereof are hereby incorporated by reference into this application.

Within the scope of submarine combat, one uses both active as well as passive systems to locate submarines.

With active systems ( for example SONAR ), a search signal, in general, an acoustic signal in the sonic or infrasonic region is radiated from on board a search vehicle, for example, from a frigate. These search signals are reflected from the outer surface of the submarine and reach receivers on board the searching vehicle such that, from these received signals, by means of suitable analysis procedures, the position of the submarine can be determined.

It is known in the art that, in order to protect submarines from such active position-finding methods, the submarine is furnished with a coating on its outer hull which absorbs, as well as possible, the impinging acoustic signals.

An underwater vessel which is intended to be camouflaged from detection by low frequency active sonar, that is, a active acoustic locating system, is known in the art from DE-OS 33 32 754. Towards this end, wide band wedge-shaped absorbers are arranged, in particular, on the bow and on the bow side of the tower area which, for their part, are fitted to the respective ship contours and which, themselves, have no acoustic reflection properties. In this manner the detectability of the submarine, namely the so-called target size, should be reducible by approximately 10 to 15 dB.

The reduction of turbulent flow around submerged parts of submarines through the introduction of chemical additives has also been proposed (DE-OS 23 18 304).

Passive location methods, on the other hand, exploit physical phenomena caused by the submarine itself. In this manner, for example, it is known in the art that the perturbation on the earth's magnetic field by the submarine's metallic parts can be exploited in order to locate submarines. Accordingly, locating probes are known in the art which are based on the principle of nuclear magnetic resonance and which are towed by ships or airplanes on a long line over the region of the sea being searched in order to detect distortions in the earth's magnetic field.

A further passive locating method as is, for example, described in EP-PS 63 517, EP-OS 120 520 as well as in EP-PS 213 418 is based on the measurement of acoustic signals which are radiated from the submarine. Namely, a submarine radiates sound into the surrounding sea water to the extent that moving parts in the submarine transfer vibrations to the outer hull. Primarily, measurable acoustic signals are produced by moving propulsion elements of the submarine such as from the rotating parts of the drive-motor and from the shaft, whereby the rotating propeller and the cavitation caused by the propeller must also be considered as acoustic sources. Finally, acoustic signals are also produced by the operation of the elevator and depth rudders, through the release of air, and through the displacement of trimming loads, all of which can be detected with appropriately sensitive passive locating systems on board modern frigates.

Moreover, in this connection, submarines with a nuclear propulsion mechanism have the particular feature that nuclear reactors, as employed on board submarines, are usually equipped with periodically actuated control rods. The control rods are moved with a preset frequency in the reactor vessel, whereby the depth of immersion of the control rods is adjustable so that, in this manner, the power output of the nuclear reactor can be adjusted. However, as a result of the periodic motion of appreciably large masses, there arises a relatively intense acoustic signal which can be utilized for the location of these types of nuclear propelled submarines.

On the other hand, it is known in the art that, with modern passive acoustic locating systems of ever increasing sensitivity, it is also necessary to consider, to a greater extent, the sound which is present in the submarine's environment. This sound of natural origin is essentially produced by sea currents, waves, schools of fish and the like.

In operating passive acoustic locating systems this environmental sound is noticeable as noise which, depending on the environmental conditions, can assume a uniform or non-uniform frequency distribution.

Known in the art from DE-OS 34 06 343 is a method with which acoustic signals from submarines whose intensities lie only slightly above that of the environmental noise can be distinguished from the environmental noise.

Numerous measures are known in the art for preventing the detection of submarines using the passive acoustic locating systems described above.

The principal measures consist naturally of minimizing the entire acoustic output of the submarine. In order to achieve this, machine parts are utilized which are as silent as possible, for example bearings, particularly in the propulsion area of the submarine, so that the entire amount of acoustic energy produced is kept as small as possible.

Furthermore, it is also known in the art within the purview of the method and the apparatus of the above mentioned kind, to undertake acoustic attenuation measures on board submarines in order to at least keep unavoidable sound from reaching the outer hull. The attenuators used for this purpose are elastic and vibration absorbing parts known in the art which, together with the mechanical elements being attenuated, constitute a spring-weight system. These kinds of known methods are, within the context of the present invention, denoted as "passive attenuation". Making the outer hull double-walled and flooding the, by way of example, 30 cm thick space between the double walls with sea water in order to minimize the amount of acoustic waves which reach the outer hull of the submarine is, for example, known in the art.

Furthermore, in dangerous situations, the amount of radiated acoustic waves can also be reduced by reducing propulsion power through so-called "Schleichfahrt". However, this diminishes naturally the submarine's ability to escape detection by distancing itself from enemy ships.

Known in the art from DE-OS 36 00 258 is an electrical installation for submarines which exhibits means of camouflage. In the arrangement which is known in the art, one takes into consideration the fact that a submarine alternating current network operates in the frequency range between 60 Hz and 400 Hz and that it is unavoidable that frequencies in this frequency range including harmonics are released via the hull into the surrounding water. Accordingly, in the electrical installation known in the art, the alternating current network of the submarine is provided with a frequency of, for example, 30 kHz which lies far above the receiver frequency range of hostile locating systems.

However, this electrical installation which is known in the art has the disadvantage that it can only effect a camouflage of the submerged submarine so long as enemy passive locating systems do not also operate in the frequency range region of, for example, 30 kHz. There fore, in an installation known in the art, as soon as the precautions taken are known to the respective enemy, said enemy can, through appropriate reconfiguration of his passive locating system, locate the submerged submarine by examining the new frequency range.

Finally, it is also known in the art how to disrupt passive acoustic locating systems on board enemy ships by dropping objects which radiate with high acoustic power, thereby saturating the sensitive receivers of the passive acoustic locating system.

In this manner, for example, known in the art from DE-OS 33 00 067 is an apparatus to disrupt the location of submarines with which a body can be expelled from a submarine which is equipped to release sound. This body serves to confuse a sonar system, that is to say, an active acoustic locating system on board an enemy vessel.

Known in the art from EP-OS 237 891 is a device to disrupt and decoy water acoustic locating arrangements. In the device which is known in the art, a carrying body is equipped with pyrotechnic charges the burn-up of which leads to the pulsed release of gas bubbles which, for example, cause low frequency structure-born vibrations and high frequency vibrations of outer cavitating layers of a housing, from which they emerge to also form a bubble-curtain. The device known in the art is supposed to effect diversion from the object to be protected and, through the slowly drifting accumulation of bubbles, simulate a reflecting target.

However, the range of applicability of this kind of disruptive object is limited to the case where the presence of the submarine is already known on board the enemy ship and what should be prevented is only the ability to precisely locate fired torpedos with passive acoustic locating systems, which are also in motion and emitting sound. These types of disruptive objects are not suited for a situation in which a submarine wishes to remain completely undiscovered.

Accordingly, it is the purpose of the present invention, to further develop a method and a submarine of the above mentioned kind in such a way that the localization through passive acoustic localizing systems is made substantially more difficult if not, thereby, impossible.

This purpose is achieved according to the invention in accordance with the above mentioned method, in that, an evacuated intermediate space is inserted in the transport path.

The underlying purpose of the invention is achieved in accordance with the above mentioned apparatus in that the damping means are configured as an evacuated intermediate space.

The underlying purpose of the invention is, in this manner, completely achieved. The invention takes advantage, namely, of the fact that the dispersion of sound is confined to a medium, so that a pure vacuum represents an infinite resistance to sound. Sound is, namely, in principle unable to bridge even the smallest separation in an evacuated space. Therefore, if, in accordance with the invention, one inserts an intermediate evacuated space in the transport path of acoustic waves from the inner region of a submarine to the outer hull, then the acoustic dispersion is completely cut-off or substantially reduced if one takes into account the suspensions and mechanical connections which are necessary for practical reasons.

Accordingly, the evacuated intermediate space realized can, essentially, be arbitrarily small, since as mentioned, sound is incapable of dispersion in an evacuated space, regardless of the spatial extent of said space. In practice, the dispersivity of sound in a region decreases steeply with the partial pressure in this region, so that it is fully adequate in practical applications to adjust the pressure in the intermediate evacuated space to, for example, 1 mbar. In order to adjust this pressure it is, in practice, sufficient to use rotary pumps, the so-called pre-vacuum-pumps and both weldments and feedthroughs in the adjoining walls are not critical at these partial pressures. In this pressure region it is furthermore unnecessary to always leave a pump running in order to maintain the partial pressure, rather, one can shut-off the appropriate pumps even for a long time, something which is of particular significance for the operation on board a submaring, curising with slow motion (referred to in German language as "Schleiffahrt").

In a preferred improvement of the method according to the invention, a natural vibration frequency spectrum of the inner region which determines the spatial distribution of the vibration nodes is ascertained, and a mechanical connection bridging the intermediate space between the inner region and the outer hull at the positions of the vibration nodes is established.

This measure, which in other respects also can be applied without use of an evacuated intermediate space, has the particular advantage that the acoustic transfer between the inner region and the outer hull can be further reduced through skilful selection of the support element coupling locations. Namely, it is known that the vibration amplitude at the location of a vibration node is equal to zero so that for a coupling at the location of a vibration node, no vibrations from the vibrating part can be transferred.

In a preferred embodiment of the apparatus according to the invention, the moving mechanical elements are arranged in the inner region of a compartment which exhibits an inner wall and an outer wall between which the evacuated intermediate space is configured.

This measure has the advantage that the aggregate of parts with the moving mechanical elements are completed encapsulated.

In a particularly preferred improvement of this embodiment, the outer wall is the outer hull of the submarine.

This measure has the advantage that a particularly good utilization of space is attained, since, in this case, the compartment is optimally integrated in the outer hull of the submarine.

In another preferred embodiment of the apparatus according to the invention, a vacuum pump is arranged in the inner region and is connected to the evacuated intermediate space.

This measure has the advantage that the vacuum pump which is necessary in order to maintain the partial pressure in the evacuated intermediate space is likewise acoustically decoupled from the outer hull of the submarine.

In further embodiments of the invention, the outer side of the inner wall and the inner side of the outer wall are at least partially equipped with heat conducting sheeting.

This measure takes advantage of the fact that, the heat radiation, in contrast to sound waves, are capable of surmounting evacuated intermediate spaces. In this manner, heat transfer via a path through the evacuated intermediate space is possible, in particular, in order to carry off the heat generated by the moving mechanical elements in the inner region.

This is realized in a particularly preferred manner in that the heat conducting sheeting of the outer wall is connected to a cooling device.

This is, in particular, especially advantageous when the outer wall is identical to the outer hull of the submarine, since namely then, the heat developed in the inner region can be directly transferred via the outer hull to the surrounding sea water.

In further embodiments of the invention, respective areas of the outer side of the inner wall and the inner side of the outer wall are equipped with shock bodies in such a way that the separation between the inner wall and the outer wall is reduced to an amount such that, during the occurrence of a predetermined acceleration effecting the compartment, the shock bodies come into contact with each other.

This measure has the advantage that, in the event of a collision involving the submarine, the mechanical integrity of the compartment is maintained, since, in consequence of an elastic deformation of the inner wall and/or the outer wall, initially, only the shock bodies collide with each other, so that, in this case, only an acoustic coupling between the inner wall and the outer wall is re-established without, in so doing, leading to mechanical damage. In this embodiment of the invention one also takes advantage, thereby, of the fact that even a very small evacuated intermediate space is sufficient to prevent acoustic dispersion. Therefore, if one limits, in the region of the shock bodies, the active area of the shock bodies, it is possible for the shock bodies to be separated by a distance of millimeters without thereby effecting an acoustical connection.

In further embodiments of the invention, the inner wall is supported with respect to the outer wall using shock struts.

This measure has the advantage that a further vibrational decoupling between inner region and outer hull is accomplished, since, by means of the shock struts, a damping, or otherwise desirable effect on the vibrations is, in this manner, possible in that the acoustic wave transport resistance is increased.

In a particularly preferred variation of this embodiment, the shock struts exhibit a progressive characteristic operating curve.

This measure also has the advantage that, in case of a collision, mechanical damage does not occur since the progressive characteristic operating curve effects a stiffer support of the inner wall with respect to the outer wall whereby, at this instant, an increase in the acoustic conductivity must be accepted.

In further improvements of these variations, the shock struts are arranged at the location of natural vibration frequency spectrum vibration nodes of the inner region.

This measure has the advantage already explained above, that a complete decoupling of the vibrations is possible since, in accordance with nature, no vibration can be transferred at the location of a vibration node where the vibration amplitude is equal to zero.

Particularly advantageous hereby, is, furthermore, if the shock struts are built from frames which support the inner region with respect to the outer region in the manner of a gimbal mounting.

This measure has the advantage that a further intentional modification of the vibration transfer via the many interwoven frames is possible. In this way it is, for example, in an advantageous manner, possible first to record the natural vibration frequency spectrum of the inner region and then to couple the inner region, at the location of its vibration nodes, to a first frame, then to again record the natural vibration frequency spectrum of the entire structure, and in this manner, in iterative steps, to achieve a complete vibrational decoupling using the many interwoven frames.

Finally, it is preferred in other embodiments with which the evacuated intermediate space is bridged by shock struts to equip the shock struts with feedthroughs for the transport of media or signals.

This measure has the advantage that the shock struts serve a dual purpose since they are used not only for mechanical support of the inner region but also for supplying the inner region with media, that is to say, with fluids or gases or with signals, that is to say, measurement or control signals or with electrical energy.

In other embodiments of the invention, a magnetic coupling for the transfer of mechanical energy through the evacuated intermediate space is provided for with coupling halves on the inner side of the inner wall and the outer side of the outer wall.

This measure has the advantage that a contact free transfer of mechanical energy from the inner region to the outer region or vice versa is possible without having to penetrate the evacuated intermediate space with mechanical elements.

In this case, it is particularly advantageous if, in the area of the coupling halves of the magnetic coupling, the inner wall as well as the outer wall are constructed from an electrically non-conducting material.

This measure has the advantage that the occurrence of eddy currents and, therewith, of power loss as a result of heat generation in the walls is avoided.

In further embodiments of the invention, conducting supports are arranged in the inner wall and the wall in order to transfer media through the evacuated intermediate space and the conducting supports are connected to each other by means of a flexible conducting piece.

This measure has the advantage that a continuous transfer of media through the evacuated intermediate space is possible without producing a significant acoustic connection.

Furthermore, other embodiments of the invention are preferred with which the inner wall and the outer wall are equipped with doors, whereby, a region around the doors is separable from the evacuated intermediate space by removable sealing means.

This measure has the advantage that, when the sealing means are removed, a single evacuated intermediate space is formed which provides an optimum acoustic decoupling while, for brief entrance to the inner region, the sealing means can be closed and the doors opened whereby, during this time an acoustic coupling in the region of the doors is accepted.

In further preferred embodiments of the invention, the intermediate space is bridged by means of a cableless signal transfer device.

This measure has the advantage that the transfer of adjustment or control signals or the like through the evacuated intermediate space is possible without producing a further vibrational coupling between the inner region and the outer hull due to a signal connection.

The cableless signal transfer is preferably achieved in that either a uniform magnetic field is modulated, an optical signal transfer is chosen, or electromagnetic waves, for example, shortwaves or microwaves are used.

In all cases it is possible to transfer signals with high band width from the inner region to the outside or vice versa without influencing the vibration properties of the configuration.

Clearly, the features described above and the remaining features which are explained below are applicable not only in the given corresponding combination but also in other combinations or by themselves without departing from the from a scope of the present invention.

Embodiments of the invention are represented in the drawings and will be further explained in the following description. Shown are:

FIG. 1 an extremely schematic side view, partially cut-off, of a submarine according to the invention.

Figure 2:
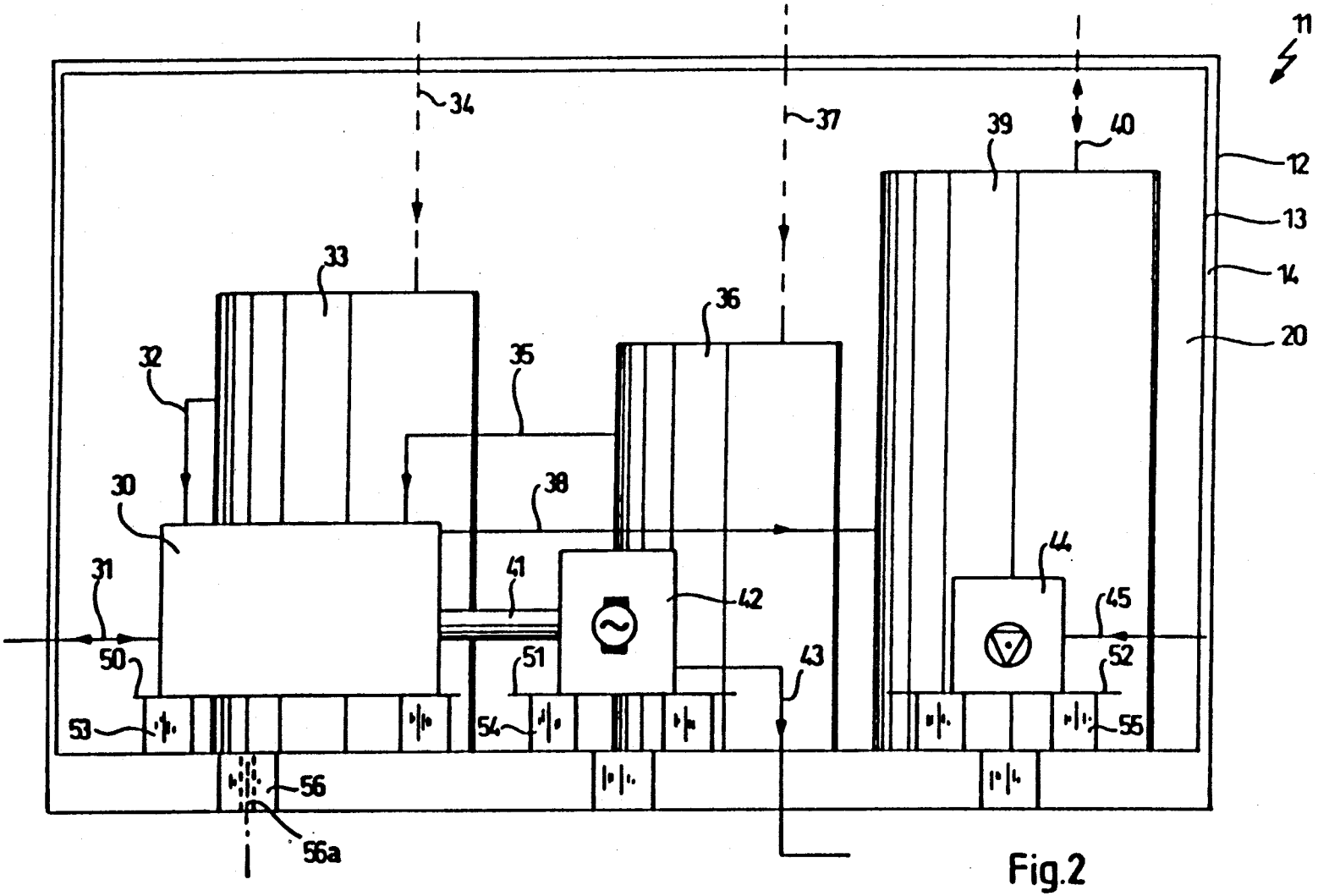

FIG. 2 a likewise schematic side view, in an enlarged scale, of a compartment in a submarine formed in accordance with the invention.

Figure 3:
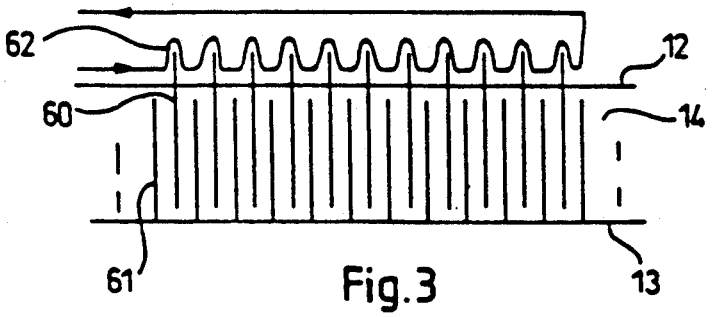

FIG. 3 a detailed view for explanation of a measure according to the invention for the transfer of heat through an evacuated intermediate space.

Figure 4:
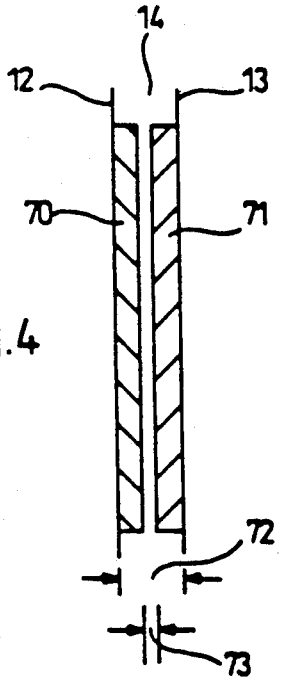
Figure 5:
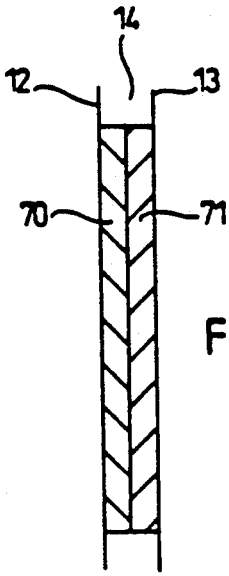

FIG. 4 and FIG. 5 two representations of shock bodies in two different states of motion.

Figure 6:
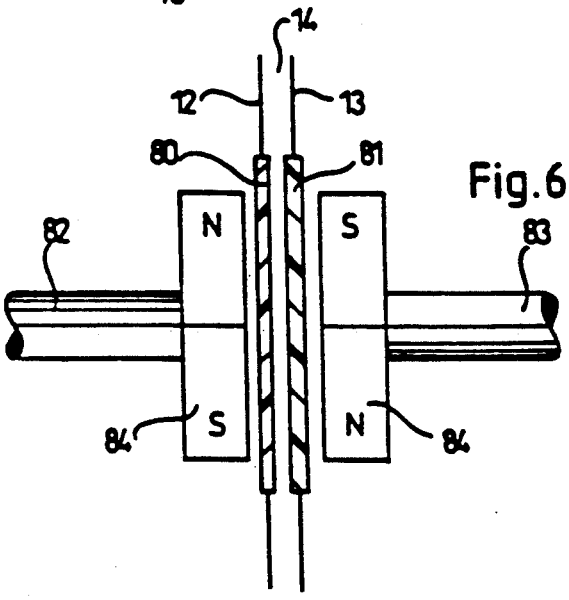

FIG. 6 a side view, partially cut-off, of a magnetic coupling for the transfer of mechanical energy through an evacuated intermediate space.

Figure 7:
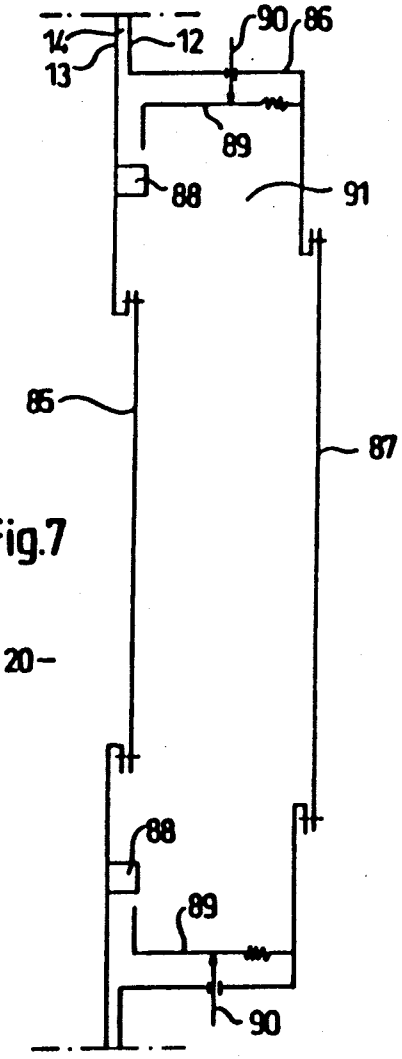

FIG. 7 a schematic side view for explanation of a door configuration with which entrance can be gained to an inner region through an evacuated intermediate space.

Figure 8:
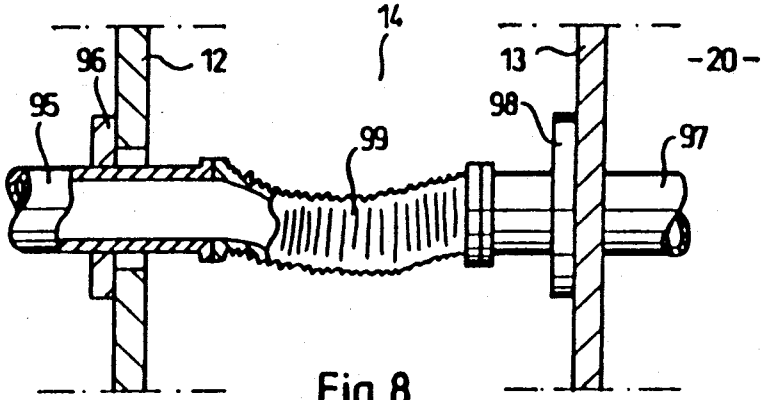

FIG. 8 a side view, partially cut-off, for explanation of a connection through an evacuated intermediate space for transfer of media.

Figure 9:
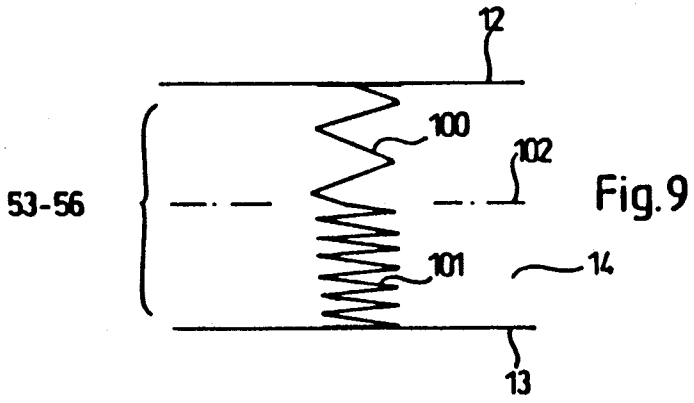

FIG. 9 an extremely schematic side view for explanation of a shock strut with progressive characteristic operating curve.

In FIG. 1, an entire submarine is labeled as 10. The submarine exhibits in the stern region a compartment 11 which is surrounded by an outer wall 12. An inner wall 13 is arranged at a distance from the outer wall 12 so that an evacuated intermediate space 14 is formed between the outer wall 12 and the inner wall 13. In the inner region 20 formed in this manner, aggregate parts 15 are located, said aggregate parts having particularly strong acoustic radiation as is indicated with arrow 16. The aggregate parts 15 which are of significance are, primarily, the propulsion mechanism, compressors or similar mechanisms with which fast moving machine parts result in the respective generation of noise.

The aggregate parts 15 are arranged on a ground plate 17 in inner region 20 which, for its part, is supported via shock struts 18 on the inner wall 13. The inner wall 13 is also supported by means of shock struts in the outer wall 12.

Through evacuation of the intermediate space 14, it is possible to arrange that the acoustic waves from the aggregate parts 15 do not reach the outer hull 19 of the submarine 10 and, thereby, that the submarine 10 gives off extremely little or no acoustic radiation into the surrounding sea water.

FIG. 2 shows the compartment 11 in further detail.

One notices, among the aggregate of parts in the inner region 20 is, first of all, a closed-loop diesel motor 30 which is connected to the outer region via an oil-cooling conduit 31. In this manner it is possible to supply the closed-loop diesel motor 30 with cooled oil from the outer region.

The closed-loop diesel motor 30 is, furthermore, via a fuel conduit 32, connected to a fuel tank 33 which is likewise located in the inner region 20 of the compartment 11. It is also the case here, that the oxygen tank 36, due to limited space, likewise contains only a certain reserve of oxygen whereas it is also possible here to refill from a larger supply tank located in another position in the submarine via conduit 37.

Finally the closed-loop diesel motor 30 is also connected to a caustic potash solution tank 39 via exhaust conduit 38. As is known, namely, with closed-loop diesel motors, the exhaust is washed in a caustic potash solution in order that the carbon dioxide in the exhaust can be dissolved in the caustic potash solution. Since in this event, the caustic potash solution must be continuously enriched, an exchange conduit 40 is provided for which removes the expended caustic potash solution from the tank 39 and supplies fresh caustic solution to the tank.

The closed-loop diesel motor 30 is mechanically connected to a generator 42 via a drive shaft 41. The generator 42 is equipped with a power cable 43 which is fed to the outside through the evacuated intermediate space 14.

Finally, FIG. 2 further shows a vacuum pump 44 in inner region 20 of the compartment 11 which is connected to the evacuated intermediate space 14 via suction conduit 45. The vacuum pump 44 serves to maintain the partial pressure in the intermediate space 14 whereby the configuration of the vacuum pump in the inner region 20 of the compartment assures that the sound radiated from the vacuum pump 44 does not reach the outer region. The vacuum pump 44 can be of a relatively simple construction (for example, a prevacuum-pump) since it is only preferentially utilized in order to maintain the partial pressure in the intermediate space 14 whereby, another pump located outside of compartment 11 can be used for the initial evacuation of the intermediate space 14. Also here it is primarily taken into account that in the compartment 11 must only contain the noise producing aggregate of parts along with their corresponding support components which are necessary for a temporary crawl drive ("Schleichfahrt").

One further notices from FIG. 2 that the closed-loop diesel motor 30, the generator 42, as well as the vacuum pump 44, being noise producing aggregate of parts, are each arranged on the base plates 50, 51, and 52 respectively. The base plates 50 through 52 are, by means of shock struts 53, 54, and 55 respectively supported on the inner wall 13 which ,in turn, is supported via additional shock struts 56 on the outer wall 12. Clearly, furthermore, the inner wall 13 can be elastically supported with respect to the outer wall 12 at a plurality of locations as well as on the side walls and on the ceiling.

The shock struts 56 which span the intermediate space 14 are, in preferred embodiments of the invention, equipped with feed-throughs as indicated in FIG. 2 with 56*a*. These feed-throughs 56*a* can serve to transfer media, that is to say, fluids or gases through the intermediate space 14. The feed-throughs 56*a* can further be applied in order to transfer electrical energy or signals from the inner region 20 to the outside or vice versa.

In FIG. 2, the shock struts 56 which span the intermediate space 14, are indicated in arbitrary locations. It is, however, particularly preferred when the location at which the shock struts are situated is judiciously chosen. Towards this end, the natural vibration frequency spectrum of the inner region is initially measured. This is done, either via an excitation, for example a transducer, loud speaker, or the like the frequency of which can be continuously tuned, or through a pulse-like excitation, for example, a sharp report with which the elastic response of the inner region 20 is transformed by means of a subsequent Fourier transformation from the time domain into the frequency domain.

The vibrations set-up in the inner region 20 can then by means of microphones, piezo-electric vibration pick-ups, optical pick-ups, or the like, be observed in a position resolved fashion, so that the space-time oscillation pattern is ascertained. These measurements can also be repeated with running aggregate parts, for example, with running closed-loop diesel motor 30 or with running vacuum pump 44 in order to determine which vibrations in the inner region 20 preferentially excite the inner wall. Thereby, clearly, it is preferred that the operating frequency of the moving aggregate parts is positioned in a frequency region outside the natural vibration frequencies of the inner region 20.

For the yet remaining inner region 20 or inner wall 13 principle vibration modes, one determines the spatial distribution of the vibration maxima and vibration nodes on the inner wall 13. One positions the shock struts 56 or other attachment or suspension devices which have been provided for at the locations of vibration nodes. Since, as is known, the vibration amplitude at the position of the nodes is equal to zero, it is in this manner possible to, in general, prevent the principle vibration mode oscillations from being transferred by way of the shock struts 56 or other support elements from the inner region 20 through the evacuated intermediate space 14 to the outer wall 12.

As an alternative to this, on can equip the shock struts 56 in such a manner that the suspension does not directly lead from the inner wall 13 to the outer wall 12, rather one or more intermediate spaces can be provided for. The nodes on the frames of the respective remaining principle vibration modes can then be successively searched for and the supports for the connections to the next respective outer frame can be positioned at these locations. These supports, themselves, can contain either passive of active vibration absorbers. In this manner, an acoustic stop filter is formed which is improved through the iterative steps mentioned in that one takes into consideration the influence of the outer frames on the vibration modes of the inner frames.

As is seen from the above considerations, in this manner, an extremely good acoustic decoupling between the inner region 20 and the outer wall 12 can already be achieved so that in the intermediate space 14, should the occasion arise, even an extremely minimal partial pressure is sufficient for the remaining acoustic decoupling or, in fact, environmental pressure can be used.

FIG. 3 shows in detail a configuration which is used to remove the heat produced in the inner region 20 from the respective aggregate parts 15 or 30,42, and 44 without having to introduce pipe conduits for a heat exchange medium through the evacuated intermediate space 14.

Towards this end, the inner side of the outer wall 12 is equipped with heat conducting sheeting 60 and the outer side of the inner wall 13 with complementary heat conducting sheeting 61. The heat conducting sheeting 60, 61 engage each other in a comb-like fashion so that the opposing radiation surfaces of the heat conducting sheeting 60 and 61 are as large as possible even in the event of a very small intermediate space 14. The heat conducting sheeting 60,61 are , functionally, painted black in order to achieve optimum radiation of heat.

In order to keep the temperature difference between the heat conducting sheets 60,61 as large as possible, the heat conducting sheeting 60 which is connected to the outer wall 12 is equipped with a cooling device 62. In this manner it is accomplished that, the heat produced in the inner region 20 is initially transferred to the inner wall 13 and then via heat radiation through the evacuated intermediate space 14, without establishing contact, to the outer wall 12 and there removed by means of the cooling device 62.

FIG. 4 and 5 show a measure which is supposed to prevent damage to the walls 12,13 of compartment 11 as a result of a shock load.

Towards this end, one must initially keep in mind that the distance between the walls 12,13 which is labeled in FIG. 4 with 72 can, in and of itself, be kept very small since a vacuum is completely non-conducting for acoustic waves regardless of its extent. With a sufficiently low pressure setting, a very minimal separation 72 between the outer wall 12 and the inner wall 13 is already sufficient to establish very good acoustic insulation. In practice, one does naturally not establish a high vacuum in the inner region 14 so that a certain minimum separation 72 must be maintained.

In order to prevent, in the event of a shock load on the submarine 10, that is in case of a collision or of running aground, the relatively unstable configuration of compartment 11 with the spring-mounted inner region 20 from being damaged, the outer wall 12 and the inner wall 13 are preferentially each equipped with a shock body which in FIG. 4 and 5 is labeled with 70 and 71 respectively. These shock bodies are arranged only in certain areas of the walls 12 and 13 respectively and on the corresponding opposite side of the walls 12 and 13 respectively are sufficiently supported to allow a stress release from the shock bodies to the outer region or the inner region respectively. Since the shock bodies 70, 71 both project into the intermediate space 14, a smaller separation 71 occurs in the region of the shock bodies 70,71 which is labeled in FIG. 4 with 73. This smaller separation 73 can easily assume the value of a few millimeters.

In the event of an extreme shock load on the submarine 10, the shock bodies 70,71 approach each other under elastic deformation of the outer wall 12 and/or the inner wall 13, until they finally touch each other as is shown in FIG. 5. In this case, a mechanically rigid structure is formed, the accelerating forces which occur can be optimally transferred from the inner region 20 onto the outer region. Naturally, at this moment an acoustic bridge exists between the shock bodies 70, 71, this can however be temporarily accepted in the event of a shock load ( collision or running aground).

FIG. 6 shows a possibility for contactless coupling of mechanical energy from the inner region 20 out into the outer region (or vice versa).

Towards this end, areas of the outer wall 12 and the inner wall 13 are equipped with a non-magnetic insert 80 or 81 made, for example, from plastic or glass. Bordering on the inserts 80,81 is a drive shaft 82 or a drive shaft 83 respectively each with a magnetic coupling body 84. The drive shaft 83 can, by way of example, be the output shaft of the closed-loop diesel motor.

The coupling bodies 84 are configured with magnetic coupling elements so that when one coupling body 84 rotates, the corresponding other coupling body 84 rotates syncronously along with it. The non-magnetic inserts are thereby instituted in order to prevent the establishment of eddy currents in the otherwise normally metallic walls 12 or 13 respectively. On take advantage her as well of the fact that, that the separation of the walls 12,13 can be made to be very small so that only a relatively small air gap remains between the magnetic coupling bodies 84.

FIG. 7 shows a possibility for making the inner region 20 of the compartment 11 accessible without venting the entire evacuated intermediate space 14 and then having to pumping it out again.

One notices in FIG. 7 an inner door 85 in the inner wall 13 as well as a some what larger outer door 87 in the outer wall 12 which overlaps the inner door 85. Towards this end, the outer wall 12 is equipped with a box-like jut 86.

A frame 88 surrounds the inner door 85 on all four sides. A compression seal 89 is swivel-mounted on the front side of the box-like jut 86 and is manoeuvrable with the operation elements 90. In the compression seal 89 position represented in FIG. 7 the region 91 which is surrounded by the box-like jut 86 is connected with the evacuated intermediate space 14 while the doors 85 and 87 are closed.

Should a passage from the outer region to the inner region 20 be established, all operation elements 90 which are distributed around the perimeter of the box-like jut 86 are adjusted towards the inside. The compression seal 89 then seats itself all around the frame 88 thereby partitioning off the region 91 from the intermediate space 14.

Henceforth, the outer door 87 and then the inner door 85 can be opened and the inner region 20 is accessible. Thereby, only the region 91 surrounded by the box-like jut 86 need be vented and later pumped out again, while the entire remaining intermediate space 14 remains evacuated.

FIG. 8 shows one of many possibilities for establishing a continuous connection between the outer region and the inner region 20 through the evacuated intermediate space 14 for a medium, that is to say, a gas or a liquid or for a cable connection.

Towards this end a first pipe conduit 95 from the outer region is attached from outside on the outer wall by means of a first flange 96. Thereby, the first pipe conduit 95 penetrates through a corresponding opening in the outer wall 12 which, for other respects, is pressure sealed by first flange 96.

In a corresponding fashion, there is a second pipe conduit 97 on the inner wall 13 and a second flange 98 establishes a pressure tight seal of the hereby necessary opening in the inner wall 13.

The pipe conduit 95 and 97 supports which jut out into the intermediate space 14 are connected to each other by means of a flexible pipe conduit 99.

In this manner, a continuous pipe connection is established between the outer region and the inner region 20, with which a gas or a fluid can be passed from the outside to the inside or from the inside to the outside or through which a slack cable connection can be passed.

If it is not necessary to continuously establish a connection of this kind, one avails oneself of a plug connection, of the kind known, in and of itself, in the art of vacuum technology and therefore is not in need of further detailed explanation here.

It was already explained further above by means of FIG. 4 and 5, that special measures must be taken, on the one hand, to attain a coupling between inner wall 13 and outer wall 12 which is as soft as possible, which, on the other hand, should be very hard when shock loads are exerted on the compartment 11.

Towards this end, the shock struts 18 in FIG. 1, 53 through 56 in FIG. 2 respectively, can also so be realized as springs with progressive characteristic operating curve, as is highly schematically indicated by way of example in FIG. 9.

The shock strut to be recognized in FIG. 9 has at its disposal, namely, a soft spring section 100 as well as a hard spring section 101, which are separated from each other by a middle plane 102. If then, by way of example, the inner wall 12 in FIG. 9 is displaced from above to below in consequence of a shock load, then initially, the soft spring section 100 with relatively soft damping becomes effective before, following complete compression of the soft spring section 100, the hard spring section 101 goes into effect.

Clearly, this representation is to be taken as exemplary only, and also other multi-step spring configurations can be applied, including, obviously, pneumatic or hydraulic devices as is known, in and of itself, in the art of spring technology.

Particularly preferred for the shock struts 18 or 53 through 56 respectively are also so-called active shock struts, as are the subject of the parallel patent application from the same applicant on the same application day ( attorney file label 1206P101).

For the transfer of signals from the inner region 20 to the outside or vice versa, one can avail oneself of a connecting cable. However, in that, every mechanical connection between the inner region 20 and the outer wall 12 creates an acoustical bridge, cableless signal transfer is used in embodiments of the invention.

In this manner, for example, it is possible to achieve a signal transfer, in that, between inner region 20 and outer region region 12, a uniform magnetic field is applied, as was accordingly already explained further above with the aid of FIG. 6 for a moment of torsion transfer. If the uniform magnetic field is modulated, the modulation frequency can be extracted and further processed via so-called pick-up coils at the corresponding oppositely located part of the configuration.

Alternatively, an optical signal transfer can also be additionally instituted, in which, on one side, light emitting diodes (LED) and on the corresponding opposite side light sensitive elements can be used. The light which is sent or received is then likewise modulated with a signal frequency.

Finally, a cableless signal transfer is also possible by means of electromagnetic waves, for example, by means of broadcasting waves in the short-wave or microwave region.

I claim:

1. Method for the reduction of acoustic emission of submerged submarines (10) with which moving mechanical elements in an inner region deliver vibrations to an outer hull (19) via a transport path and the vibrations are damped on the transport path, characterized in that an evacuated intermediate space (14) is inserted in the transport path, a natural vibration frequency spectrum of the inner region is ascertained, the spatial distribution of the vibration nodes is determined, and a mechanical connection bridging the intermediate space (14) between the inner region (20) and the outer hull (19) at the locations of the vibration nodes is established.

2. A method of reducing acoustic emission of submerged submarines having an outer hull surrounding an inner region, moving mechanical elements being provided in said inner region and delivering vibrations to said outer hull via a vibration transmission path, wherein said vibrations are damped on said transmission path by evacuating an intermediate space inserted in said transmission path, said method comprising the steps of:

measuring a natural vibrational frequency spectrum of said inner region;

determining a spatial distribution of vibration nodes of said frequency spectrum; and establishing a mechanical connection bridging said intermediate space between said inner region and said outer hull at locations defined by said vibration nodes.

3. Apparatus for the reduction of acoustic emission of submerged submarines (10) with which damping means are arranged between moving mechanical elements arranged in the inner region of the submarine (10) and an outer hull (19) characterized in that, the damping means are configured as evacuated intermediate space (14), the moving mechanical elements are arranged in the inner region (20) of a compartment (11) which exhibits an inner wall (13) and an outer wall (12) between which the evacuated intermediate space (14) is arranged, the outer wall (12) being the outer hull (19) of the submarine (10).

4. An apparatus for reducing acoustic emission of submerged submarines having an outer hull and damping means arranged between moving mechanical elements disposed within an inner region of said submarine, said moving mechanical elements being arranged in said inner region within a compartment having an inner wall and an outer wall, said damping means being configured as an evacuated intermediate space arranged between said inner wall and said outer wall, said outer wall being said outer hull of said submarine.

5. An apparatus for reducing acoustic emission of submerged submarines having an outer hull and damping means arranged between moving mechanical elements disposed within an inner region of said submarine and said outer hull, said moving mechanical elements being arranged in said inner region within a compartment having an inner wall and an outer wall, said damping means being configured as an evacuated intermediate space arranged between said inner wall and said outer wall, and a vacuum pump disposed in said inner region and in communication with said evacuated intermediate space.

6. Apparatus according to claim 3 characterized in that a vacuum pump (44) is arranged in the inner region (20) and is connected to the evacuated intermediate space (14).

7. Apparatus according to claim 6 characterized in that the outer side of the inner wall (13) and the inner side of the outer wall (12) are each at least partially equipped with heat conducting sheeting (60, 61).

8. Apparatus according to claim 7 characterized in that the heat conducting sheeting (60) of the outer wall (12) is connected to a cooling device (62).

9. Apparatus according to any one of the claims 3, 6, 7 or 8 characterized in that the outer side of the inner wall (13) and the inner side of the outer wall (12) each have areas equipped with shock bodies (70, 71) in such a way that the separation (72, 73) of the inner wall (13) and the outer wall (12) is reduced to an amount such that the shock bodies (70, 71), upon the occurrence of a predetermined acceleration acting on the compartment (11), touch each other.

10. Apparatus according to any one of the claims 3, 6, 7 or 8 characterized in that the inner wall (13) is supported with respect to the outer wall (14) with shock struts (53 through 56).

11. Apparatus according to claim 10 characterized in that the shock struts (53 through 56) exhibit a progressive characteristics operating curve.

12. Apparatus according to claim 10 characterized in that the shock struts (53 through 56) are arranged at the location of vibration nodes of a natural vibration frequency spectrum of the inner region.

13. Apparatus according to claim 10 characterized in that the shock struts are configured as frames which support the inner region with respect to the outer region in the manner of a gimbal mounting.

14. Apparatus according to claim 10 characterized in that the shock struts are equipped with feed-throughs (56a) to transfer media or signals.

15. Apparatus according to any one of the claims 3, 6, 7 or 8 characterized in that, in order to transfer mechanical energy through the evacuated intermediate space (14), a magnetic coupling (84) is provided for with coupling halves on the inner side of the inner wall (13) and the outer side of the outer wall (12).

16. Apparatus according to claim 15 characterized in that, the inner wall (13) as well as outer wall (12), in the region of the magnetic coupling coupling halves, are formed form an electrically non-conducting material.

17. Apparatus according to any one of the claims 3, 6, 7 or 8 characterized in that, for the transfer of media through the evacuated intermediate space (14), conduit supports (95, 97) are arranged in the inner wall (13) and the outer wall (12), and that the conduit supports (95, 97) are connected to each other by means of a flexible conduit piece (99).

18. Apparatus according to any one of the claims 3, 6, 7 or 8 characterized in that the inner wall (13) and the outer wall (12) are equipped with doors (85, 87) and that a region (91) around the doors (85, 87) is separable from the evacuated intermediate space (14) by means of removable sealant (88, 89, 90).

19. Apparatus according to any one of the claims 3, 6, 7 or 8 characterized in that the intermediate space (14) is spanned by means of a cableless signal transfer device.

20. Apparatus according to claim 19 characterized in that the signals are transferred by means of a modulated uniform magnetic field.

21. Apparatus according to claim 19 characterized in that the signals are transferred optically.

22. Apparatus according to claim 19 characterized in that the signals are transferred by means of electromagnetic waves.

23. Apparatus according to claim 9 characterized in that the inner wall (13) is supported with respect to the outer wall (14) with shock struts (53 through 56).

24. Apparatus according to claim 11 characterized in that the shock struts (53 through 56) are arranged at the location of vibration nodes of a natural vibration frequency spectrum of the inner region.

25. Apparatus according to claim 24 characterized in that the shock struts are configured as frames which support the inner region with respect to the outer region in the manner of a gimbal mounting.

26. Apparatus according to claim 25 characterized in that, in order to transfer mechanical energy through the evacuated intermediate space (14), a magnetic coupling (84) is provided for with coupling halves on the inner side of the inner wall (13) and the outer side of the outer wall (12).

27. Apparatus according to claim 16 characterized in that, for the transfer of media through the evacuated intermediate space (14), conduit supports (95, 97) are arranged in the inner wall (13) and the outer wall (12), and that the conduit supports (95, 97) are connected to each other by means of a flexible conduit piece (99).

28. Apparatus according to claim 27 characterized in that the inner wall (13) and the outer wall (12) are equipped with doors (85, 87) and that a region (91) around the doors (85, 87) is separable from the evacuated intermediate space (14) by means of removable sealant (88, 89, 90).

29. The apparatus of claim 5, wherein an outer side of said inner wall and an inner side of said outer wall are each at least partially equipped with heat conducting sheeting.

30. The apparatus of claim 29, wherein said that conducting sheeting on said outer wall is connected to a cooling device.

31. The apparatus of claim 5, wherein an outer side of said inner wall and an inner side of said outer wall each have areas equipped with shock bodies such that a separation between said inner wall and said outer wall is reduced to an amount when said shock bodies touch each other upon an occurrence of a predetermined acceleration acting upon said compartment.

32. The apparatus of claim 5, wherein said inner wall is supported with respect to said outer wall by means of shock struts.

33. The apparatus of claim 32, wherein said shock struts exhibit a progressive characteristic operating curve.

34. The apparatus of claim 32, wherein said shock struts are arranged at a location of vibration nodes of a natural vibrational frequency spectrum of said inner region.

35. The apparatus of claim 32, wherein said shock struts are designed as frames interconnected as a gimbal mounting for supporting said inner wall with respect to said outer wall.

36. The apparatus of claim 32, wherein said shock struts are equipped with feed-throughs for transferring media or signals.

37. The apparatus of claim 5, wherein a magnetic coupling is provided having coupling halves on an inner side of said inner wall and an outer side of said outer wall for transferring mechanical energy through said evacuated intermediate space.

38. The apparatus of claim 37, wherein said inner wall as well as said outer wall are made from an electrically non-conducting material in the region of said magnetic coupling halves.

39. The apparatus of claim 5, wherein conduit supports are arranged in said inner wall and in said outer wall for transferring media through said evacuated intermediate space, said conduit supports being connected to each other by means of a flexible conduit piece.

40. The apparatus of claim 5, wherein said inner wall and said outer wall are equipped with doors, a region around said doors being separable from said evacuated intermediate space by means of a removable sealant.

41. The apparatus of claim 5, wherein said intermediate space is spanned by means of a cableless signal transfer device.

42. The apparatus of claim 41, wherein said signals are transferred by means of a modulated uniform magnetic field.

43. The apparatus of claim 41, wherein said signals are transferred by optical means.

44. The apparatus of claim 41, wherein said signals are transferred by means of electromagnetic waves.

45. Apparatus according to claim 28 characterized in that the intermediate space (14) is spanned by means of a cableless signal transfer device.

* * * * *

UNITED STATES PATENT AND TRADEMARK OFFICE

CERTIFICATE OF CORRECTION

PATENT NO. : 5,136,547

DATED : August 4, 1992

INVENTOR(S) : Gunther Laukien

It is certified that error appears in the above-indentified patent and that said Letters Patent is hereby corrected as shown below:

On the title page, item (54):

Delete "FOR REDUCING FOR REDUCING", and insert --FOR REDUCING--.

--[22] PCT Filed: Mar. 16, 1990--

--[30] Foreign Application Priority Data
Mar. 16, 1989 [DE] Fed. Rep. of Germany...3908572.4--

Signed and Sealed this

Thirtieth Day of November, 1993

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,136,547

DATED : August 4, 1992

INVENTOR(S) : Günther Laukien

It is certified that error appears in the above-indentified patent and that said Letters Patent is hereby corrected as shown below:

On the cover page:

Insert the following after item [22] Filed:

--[86] PCT No.: PCT/DE90/00195
§371 Date: Nov. 15, 1990
§102(e) Date: Nov. 15, 1990--

--[87] PCT Pub. No: WO 90/10927
PCT Pub. Date: Sep. 20, 1990--

Signed and Sealed this

Twenty-second Day of February, 1994

Bruce Lehman

*Attest:*

BRUCE LEHMAN

*Attesting Officer*

*Commissioner of Patents and Trademarks*